United States Patent [19]

Klop

[11] Patent Number: 4,637,522

[45] Date of Patent: Jan. 20, 1987

[54] LOCKING LID FOR OVERFILL-SPILLAGE PROTECTION SYSTEM

[75] Inventor: Elmer P. Klop, Grand Haven, Mich.

[73] Assignee: Enterprise Brass Works, Inc., Muskegon, Mich.

[21] Appl. No.: 829,409

[22] Filed: Feb. 13, 1986

[51] Int. Cl.[4] ..... B65D 45/04

[52] U.S. Cl. ..... 220/322; 220/86 R; 220/85 VR; 220/85 VS

[58] Field of Search ..... 220/315, 322, 318, 86 R, 220/85 VR, 85 VS

[56] References Cited

U.S. PATENT DOCUMENTS 1,364,826 1/1921 Barin ..... 220/322

3,394,836 7/1968 Millard ..... 220/322

*Primary Examiner*—George T. Hall

*Attorney, Agent, or Firm*—Basile, Weintraub & Hanlon

[57] ABSTRACT

A locking lid assembly for sealably closing the upper end of a cylindrical stack of a fuel spillage capture recovery device includes a lid hingedly mounted on an annular base member constructed to be sealingly seated upon the top of the stack. Diametrically opposed pivoted cams mounted on the lid are wedgingly engageable with locking pins mounted on the base member to firmly compress a resilient annular seal between the lid and base member.

4 Claims, 5 Drawing Figures

LOCKING LID FOR OVERFILL-SPILLAGE PROTECTION SYSTEM

BACKGROUND OF THE INVENTION

Underground storage tanks employed in gasoline service stations are conventionally refilled by means of a filler pipe which projects upwardly from the buried tank into a relatively shallow manhole in the concrete apron of the service station. To provide convenient access to couple and uncouple the supply hose of the supply truck to the top of the filler pipe, the sides of the manhole are spaced a reasonable distance from the filler pipe. The bottom of the manhole is normally defined by fill dirt or a mixture of pea gravel.

Because of the relatively large capacity of the underground storage tanks, refill fuel is pumped into the tank at a fairly substantial flow rate which may result in overfilling the tank. Carelessness in uncoupling the supply hose, where the hose has not been completely drained, will result in spillage of gasoline into the fill surrounding the filler pipe when the hose is uncoupled.

Contamination of the soil by such spillage is obviously undesirable and various states now require that protective devices which will prevent such spillage from reaching the soil be employed.

Typically, these protection devices take the form of a closed tank surrounding the upper end of the filler pipe which will capture the spilled fuel, store the captured fuel and conduct the captured fuel to the storage tank when the tank has room to receive the fuel. Such protective tanks will have a capacity of approximately 35 gallons to enable spillage to be stored at least temporarily in the event the spillage results from overfilling of the main storage tank.

To afford sufficient access to the top of the filler pipe, such spillage capture tanks are normally formed with a relatively large diameter cylindrical stack which surrounds the upper end of the filler pipe and provides a sufficient clearance radially from the filler pipe to make coupling and uncoupling of the supply hose to the filler pipe convenient. This enlarged stack further is of a sufficient diameter to assure that all spillage normally encountered will be captured.

Because the top of this stack must be located below the surface of the concrete and the manhole cover does not provide a watertight seal, it is necessary that a cover be mounted upon the top of the capture tank stack to seal the interior of the capture tanks at all times when the cover is not opened during filling operations. This seal is necessary to prevent entry of ground water, as in the case of heavy rain, into the capture tank and to prevent the escape of volatile fumes from the capture tank when it is storing spilled gasoline.

The present invention is especially directed to a locking lid assembly for accomplishing this last purpose which will provide a compressed and completely adequate seal when the lid is closed while at the same time providing an easy release so that the lid may be easily opened for access to the filler pipe.

SUMMARY OF THE INVENTION

In accordance with the present invention, a locking lid assembly includes an annular base member constructed to be seated upon the top of a cylindrical spillage capture tank to extend around the outer periphery of the stack and to present a continuous annular sealing surface somewhat above the top of the stack. A lid is mounted upon the annular base member for hinging movement about a hinge axis extending generally tangentially of the annular base member so that the lid may rest upon the base member when in a closed position or be hinged upwardly 90° or more into an open position in which access to the filler pipe within the stack may be had through the central opening of the annular base member. The base member is sealed to the stack around the outer periphery of the stack.

The base member is also constructed with a pair of locking pins which project radially outwardly from the base member at diametrically opposed positions lying on a diameter parallel to the hinge axis. A pair of locking cams are mounted on the lid for movement about a pivot axis parallel to the hinge axis and located slightly above the top of the lid. The cams are disposed adjacent diametrically opposed sides of the cover and, when the cover is in the closed position, may be pivoted into underlying engagement with the respective locking pins. The surfaces of the cams which engage the locking pins are concavely curved surfaces which, as the cams are pivoted to a locking position, progressively wedge the lid toward the cover with a wedging action. A resilient annular seal mounted on the inner side of the lid is thus compressed around its entire periphery against the upper surface of the base member to provide a relatively tight seal. Each of the cams is formed with an arm portion which projects radially from the pivot axis of the cam and these two arms are connected at their outer ends to each other by means of a rigid operating bar which, when manually moved, simultaneously pivots both cams to and from the locking position. The cams may be pivoted from their locking position to a release position in which they are disengaged with the locking pins to permit the lid to be opened.

Other objects and features of the invention will become apparent by reference to the following specification and to the drawings.

IN THE DRAWINGS

Figure 1:
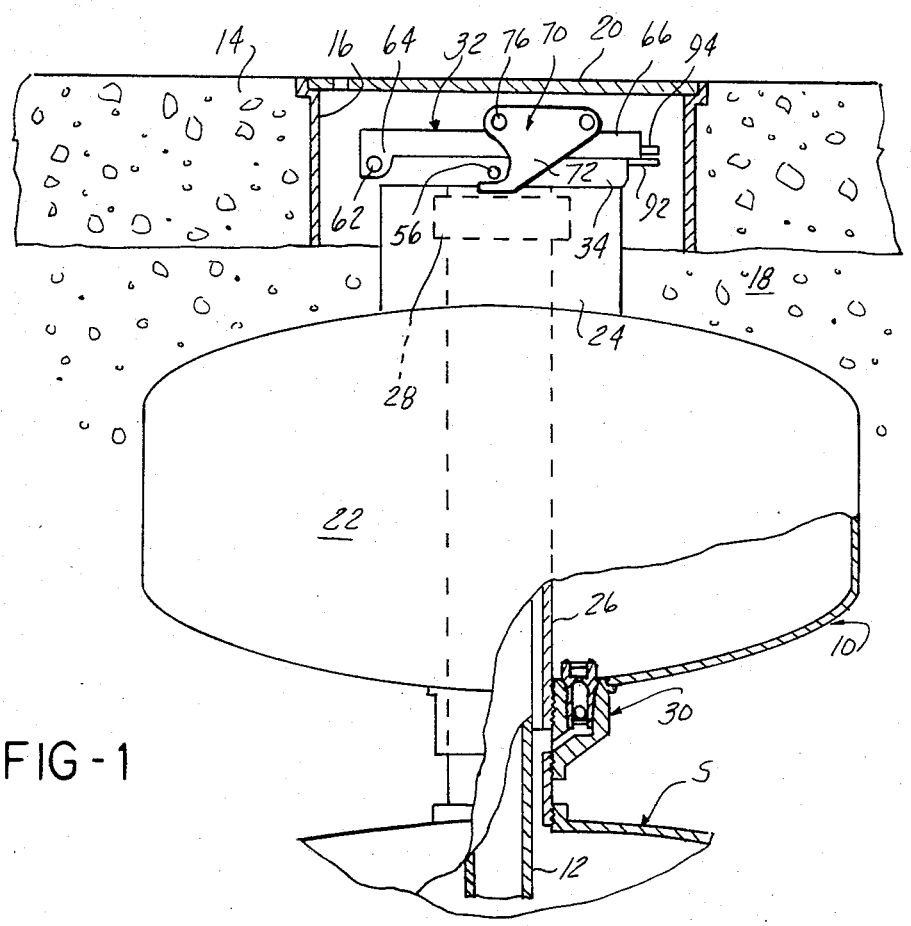
FIG. 1 is a side view, partially in section with certain parts broken away, of a spillage capture or recovery tank employing a locking lid embodying the present invention.

Referring first to FIG. 1, there is shown a capture or recovery tank system designated generally 10 installed upon an underground fuel storage tank designated generally S to capture and recover fuel which may be spilled in connection with the refilling of storage tank S through a filler pipe 12. Storage tank S is buried underground in the usual manner and, as is conventional, the upper end of filler pipe 12 is located below the surface of the concrete service station apron 14 within a manhole 16 which projects entirely through concrete 14 to the earth or gravel fill 18. The top of manhole 16 is closed by a removable metal cover 20 shown only in FIG. 1.

As best seen in FIG. 1, the capture or recovery system 10 includes a closed tank 22 constructed with an upwardly projecting, open-ended, cylindrical stack 24.

An open-ended tube 26 is sealingly connected at its lower end within an opening in the bottom of tank 22 to surround the filler pipe 12. Both the outer tube 26 and filler pipe 12 are open at their upper end and are normally closed by a cap 28, the upper end of tube 26 being sealed to the outer periphery of filler tube 12. A one-way valve designated generally 30 provides for flow from the interior of capture tank 22 into storage tank S, but will seat to prevent the flow of fuel from an overfilled storage tank S upwardly into tank 22.

The open upper end of cylindrical stack 24 is normally closed by a locking lid assembly designated generally 32 which constitutes the present invention. Adequate sealing of the upper end of cylindrical stack 24, except during filling operations, is required to prevent ground water from getting into the interior of tank 22 and to prevent the escape of fumes from fuel contained in tank 22 when storage tank S is overfilled and valve 30 is closed to prevent the flow of fuel from tank 22 into tank S.

Figure 3:
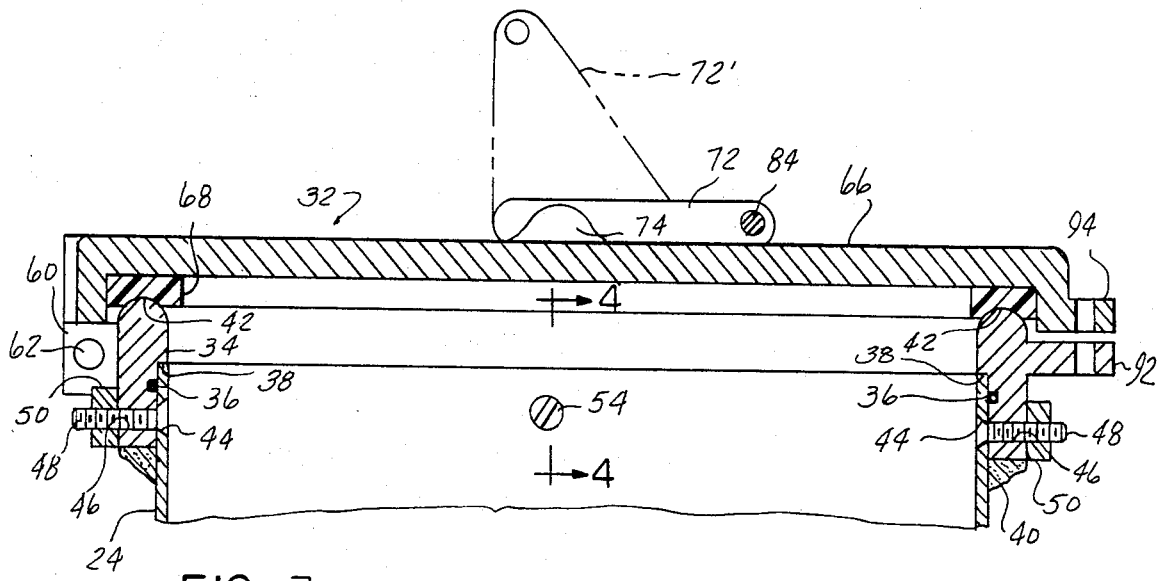
FIG. 3 is a detail cross-sectional view taken on the line 3—3 of FIG. 2.
Figure 4:
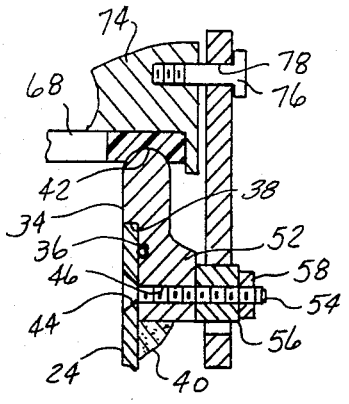
FIG. 4 is a detail cross-sectional view taken on the line 4—4 of FIG. 3.

Locking lid assembly 32 includes an annular base member 34 which, as best seen in FIGS. 3 and 4, is formed with an annular recess 38 around its inner periphery which is conformed to enable base member 34 to be seated upon the top of cylindrical stack 24 in a reasonably snugly fitting relationship. An O-ring 36 sealingly engages the outer side of stack 24 and a silicone sealant 40 is also applied around the periphery of the lower edge of base member 34 and stack 24 to provide a watertight peripheral seal. The upper edge of base member 34 is rounded as at 42 to provide a seal-engaging surface.

Four bores 44 extend through the wall of cylindrical stack 24 near its upper end, the bores 44 being spaced 90° from each other and located to match four radial bores 46 through annular base member 34 when the base member is seated on stack 24. Referring to FIG. 3, mounting bolts 48 project through two diametrically opposed sets of bores 44–46, and nuts 50 threaded on the projecting ends of bolts 48 are employed to mechanically secure base member 34 in its assembled relationship to stack 24.

Referring now to FIG. 4, the two remaining bores 46, one of which is shown in FIG. 4, pass through portions of the wall of base member 34 which have been formed with a thickened, outwardly projecting pad 52. A bolt 54 projects through each of these last two diametrically opposed bores 46 to support a cylindrical locking pin 56 threaded onto bolt 54 and firmly held in position by a lock nut 58.

Figure 2:
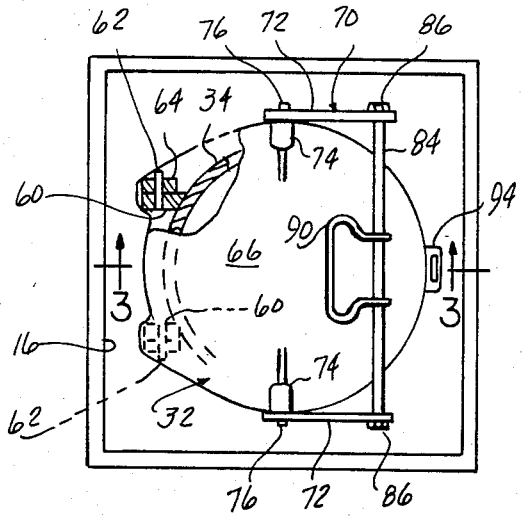
FIG. 2 is a top plan view of the locking lid of FIG. 1.

Referring now to FIG. 2, base member 34 is formed with a pair of integral, outwardly projecting hinge brackets 60 which carry hinge pins 62 which are received in ears 64 integrally formed on a cover lid 66. Hinge pins 62 define a hinge axis which extends generally tangentially of base member 34, as best seen in FIG. 2.

Lid 66, when in the closed position shown in FIGS. 2 and 3, completely overlies bsae member 34. When closed, a resilient annular seal 68 adhesively bonded to the underside of lid 66 rests upon the rounded top edge 42 of base member 34. Lid 66 is tightly held in its closed position by a locking cam assembly designated generally 70.

Cam assembly 70 includes a pair of plate-like cams 72 located, as best seen in FIG. 2, at diametrically opposed sides of lid 46. Lid 46 is formed with a pair of protuberances 74 which, as best seen in FIG. 4, threadably receive a pivot pin 76 rotatably received within a bore 78 in each cam plate 72. The plates 72 are thus mounted upon lid 66 for pivotal movement about a pivot axis defined by the pins 76 which is parallel to the hinge axis defined by hinge pins 62 and which is elevated slightly above the upper surface of lid 66.

Figure 5:
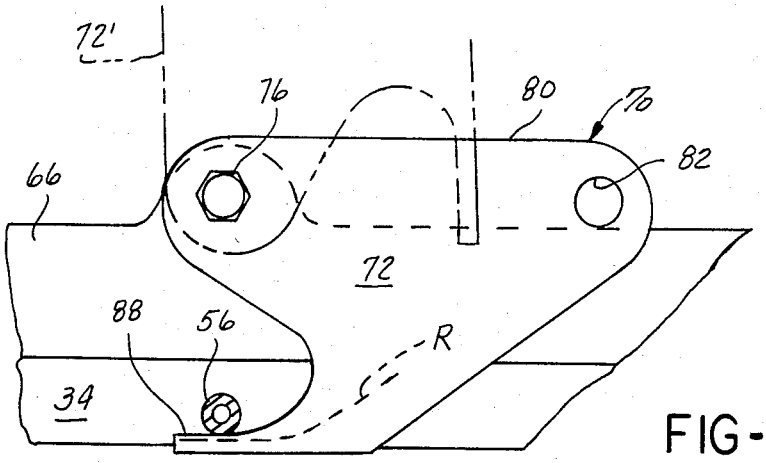
FIG. 5 is a partial side elevational view of the locking cam employed in the locking lid of FIG. 1.

Referring now to FIG. 5, each cam 72 is formed with an arm portion 80 which extends radially from pivot 76, and a second bore 82 passes through cam 72 near the end of arm portion 80 remote from pivot 76. As best seen in FIG. 2, a rigid bar 84 extends between and through bores 82 and is fixedly coupled at each end to the respective cams 72 as by nuts 86 threaded on projections of bar 84 which pass through the bores 82. Bar 84 thus affords a means by which the two cams 72 may be pivoted in unison about pivots 76.

In FIG. 5, a cam 72 is shown at or closely adjacent its locking position in solid line in which a concavely curved cam surface 88 is engaged beneath a locking pin 56 to hold lid 66 in its closed position. The cam 72 may be pivoted about pivot 76 from the solid line position shown in FIG. 5 to a broken line position partially indicated at 72' in which cam surface 88 is fully disengaged and clear of pin 56 to permit the lid 66 to be hinged upwardly about hinge axis 62 to an opened position.

The concavely curved cam surface 88 of each cam 72 faces the pivot axis. The radial distance from the axis of pivot 76 to cam surface 88 decreases in a counterclockwise direction as viewed in FIG. 5, this decrease being illustrated by a comparison of the curvature of cam surface 80 to a constant radius from the axis of pivot pin 76 indicated by the broken line designated by reference numeral R in FIG. 5. Thus, as the cam 72 shown in FIG. 5 is moved in a clockwise direction about the axis of pivot 76, the locking pin 56 is engaged by cam surface 88 with a wedging type action which increasingly draws lid 66 downwardly against base member 34 to compress seal 68.

As best seen in FIG. 2, cams 72, when in their locked position, extend from their pivot axis in a direction away from the hinge axis and, from a comparison of FIGS. 2 and 5, it is seen that as the cams move toward their locking position, the operating bar 84 moves downwardly toward the top of lid 66. Thus, the wedging action exerted by cams 72 may be firmly applied since the person closing the lid has simply to step upon bar 84 to firmly seat the lid. Bar 84 extending across the top of lid 66 provides a stop limiting the wedging action to a reasonable amount. A handle 90 may be pivotally mounted upon bar 88 to assist in releasing the cams from their locked position.

If desired, hasp-like projections 92 and 94 may be integrally formed on base member 34 and lid 66 so that the lid may be padlocked in its closed position.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

I claim:

1. A locking lid assembly for use in closing the open top of a cylindrical stack of a spill containment chamber or the like, said locking lid assembly comprising an annular base member adapted to be seated upon the top of said stack with said base member extending around the outer periphery of said stack and projecting upwardly above the top of said stack, a cover lid mounted on said base member for hinging movement about a hinge axis extending generally tangentially of said base member between a closed position wherein said lid overlies said base member and an open position wherein said lid is hinged upwardly about said hinge axis from said closed position, resilient annular sealing means engageable between said lid and the upper surface of said base member to define a continuous annular fluid-tight seal between said lid and said base member when said lid is in its closed position, a pair of locking pins projecting radially outwardly from said base member at diametrically opposed locations, a pair of locking cams pivotally mounted at diametrically opposite sides of said lid for pivotal movement about a pivot axis parallel to said hinge axis and above the top of said lid, said cams each including an arm portion extending generally radially from said pivot axis in a first direction and a locking pin engaging cam portion radially offset from said pivot axis and angularly displaced about said hinge axis from said arm portion, said cams being pivotal, when said lid is in its closed position, between a cam release position and a locking pin engaging lock position, said arm portions of said cams when in said release position projecting upwardly above the top of said lid and said cam portions being disengaged from said locking pins to accommodate movement of said lid to its open position, said cams when in said lock position having their arm portions extending generally parallel to the top of said lid and said cam portions wedgingly engaged beneath said locking pins to compresss said annular sealing means between said lid and base member.

2. The invention defined in claim 1 further comprising a rigid bar member fixedly secured to, and extending between, the ends of said cam portions remote from said pivot axis rigidly coupling said locking cams to each other for simultaneous movement about said pivot axis.

3. The invention defined in claim 1 or 2 wherein said cam portion of each cam comprises means defining a concave curved edge surface on said locking cam facing said pivot axis and movable laterally across the side of said locking pin remote from said lid as said cam is moved from its release position to its locking position with the radial distance between said pivot axis and the portion of said edge surface engaged with said locking pin decreasing as said cam moves toward said lock position.

4. The invention defined in claim 1 or 2 wherein said arm portions of said locking cams extend from said pivot axis in a direction away from said hinge axis when said locking cams are in their lock position.

* * * * *